US007771244B1

(12) United States Patent
Ju

(10) Patent No.: US 7,771,244 B1
(45) Date of Patent: Aug. 10, 2010

(54) ELECTRICAL CONNECTOR

(75) Inventor: Ted Ju, Keelung (TW)

(73) Assignee: Lotes Co., Ltd, Keelung (TW)

( * ) Notice: Subject to any disclaimer, the term of this patent is extended or adjusted under 35 U.S.C. 154(b) by 0 days.

(21) Appl. No.: 12/479,919

(22) Filed: Jun. 8, 2009

(51) Int. Cl.
*H01R 11/22* (2006.01)

(52) U.S. Cl. ..... 439/857; 439/83; 439/342

(58) Field of Classification Search ..... 439/342, 439/83, 857, 886
See application file for complete search history.

(56) References Cited

U.S. PATENT DOCUMENTS

| | | | | |
|---|---|---|---|---|
| 4,997,385 | A * | 3/1991 | Casagrande | 439/259 |
| 5,980,337 | A * | 11/1999 | Little | 439/857 |
| 6,224,432 | B1 * | 5/2001 | Billman | 439/856 |
| 6,247,954 | B1 * | 6/2001 | Ju | 439/342 |
| 6,471,534 | B1 * | 10/2002 | Lee | 439/342 |
| 6,482,023 | B1 * | 11/2002 | Tan | 439/342 |
| 6,533,590 | B1 * | 3/2003 | Lee et al. | 439/83 |
| 6,533,591 | B1 * | 3/2003 | Lee | 439/83 |
| 6,638,119 | B1 * | 10/2003 | Chang | 439/857 |
| 6,843,662 | B2 * | 1/2005 | Ju | 439/83 |
| 7,297,007 | B2 * | 11/2007 | Hao | 439/83 |
| 7,377,789 | B1 * | 5/2008 | Liu | 439/66 |
| 7,601,036 | B2 * | 10/2009 | Cheng et al. | 439/857 |
| 7,699,638 | B2 * | 4/2010 | Zhang | 439/342 |
| 2003/0186576 | A1 * | 10/2003 | Lin | 439/342 |
| 2004/0009694 | A1 * | 1/2004 | Lai | 439/342 |
| 2004/0198102 | A1 * | 10/2004 | Xiang et al. | 439/857 |
| 2006/0258200 | A1 * | 11/2006 | Hao | 439/342 |
| 2008/0101047 | A1 * | 5/2008 | Wang et al. | 361/767 |
| 2008/0227324 | A1 * | 9/2008 | Cheng et al. | 439/342 |
| 2009/0093171 | A1 * | 4/2009 | Ju | 439/824 |

* cited by examiner

*Primary Examiner*—Ross N Gushi
(74) *Attorney, Agent, or Firm*—Ming Chow; Sinorica, LLC

(57) ABSTRACT

The present invention relates to an electrical connector used for connecting a mating device with multiple pins and comprising a body and at least one terminal. The terminals are secured in the body and have at least one coarse surface and at least one glossy surface with a protection layer of noble metal. The coarse surfaces and the glossy surfaces locate at a position for making the pins scrape with the coarse surfaces and finally contact the coarse surfaces and the glossy surfaces simultaneously.

13 Claims, 6 Drawing Sheets

ELECTRICAL CONNECTOR

FIELD OF THE INVENTION

The present invention relates to an electrical connector, and particularly to an electrical connector that electrically connects a jointing device to a circuit board.

BACKGROUND OF THE INVENTION

With advances in electronic technologies, the requirement for the electrical conducting performance between a chip module and a circuit board is stringent increasingly. Generally, the surfaces of the multiple pins of the chip module and the multiple terminals of an electrical connector tend to be contaminated by dust. Alternatively, during the process of soldering the electrical connector to the circuit board, the smoke of soldering flux also tends to cover the surfaces of the terminals that forms grime on the surfaces of the terminals. Said dust and grime greatly increase contact impedance between the pins and terminals, and thus severely deteriorate electrical conductivity therebetween. Thereby, how to reduce the contact impedance becomes extremely important.

Presently, there exist terminals with two different structures. The first structure is an improved terminal and is disclosed in China Patent Number 97202231.7. The improved terminal has two side conducting pieces and an elastic piece used for plugging pin of a chip module and for contacting and conducting. However, when a computer host is assembled and during the early stage of powering on, because the surfaces of said two side conducting pieces and the elastic piece are glossy with low coefficient of friction, dust and grime are hard to be scraped temporarily when the pins are plug into the improved terminals. It is necessary to disassemble the computer host and use a driving means in the electrical connector to scrape the pins with the two side conducting pieces and the elastic piece for several times for thinning and removing the dust and grime. Then normal power-on can be truly realized. Thereby, there is a conducting problem during powering on for the first structure.

The second structure is a conductive clip disclosed in China Patent Number 01255459.6. The metal material of the conductive clip is cut to form a slide trench for connecting to a pin. Because the slide trench is formed by cutting, there exist tiny burrs on the inner surface thereof, making the surface coarse with a large coefficient of friction. When the pin plugs into the slide trench, the inner surface of the slide trench tends to scrape dust and grime, and thus reducing effectively the contact impedance. Thereby, after the computer is assembled, initial power-on can be performed smoothly.

However, practically, when the inner surface of the slide trench scrapes the dust and grime, the gold plating layers used for preventing oxidation on the pin and the conductive clip are scraped as well, which makes copper or other metals for electrical conduction exposed in the air. The exposed metal materials tend to react with oxygen and produce oxides, which definitely will increase the contact impedance and deteriorate conduction between the pin and the conductive clip. Even worse, the electrical conduction will be broken.

Accordingly, it is essential to design a novel electrical connector, which can solve the problem of the inferior conduction during power-on, and also can guarantee continuous electrical conduction.

SUMMARY

An objective of the present invention is to provide an electrical connector, which can conduct effectively during power-on, and also can guarantee continuous electrical conduction.

For achieving the objective described above, the novel electrical connector according to the present invention is used for connecting a mating device with multiple pins, and comprises a body and one or more terminals secured in the body. The terminal has one or more coarse surfaces and one or more glossy surfaces with a protection layer of noble metal. The coarse surface and the glossy surface are situated at a location such that when installing, the pin will scrape the coarse surface, and simultaneously contact the coarse and glossy surfaces eventually.

The electrical connector according to the present invention is used for connecting a mating device with multiple pins, and comprises a body and one or more terminals secured in the body. The terminal is punched from a metal sheet, and comprises two contact arms formed by punching away the material at the center. Two punching sections are formed at the inner sides of the two contact arms. Besides, the terminal also comprises an elastic piece. At the inners side of the elastic piece, a glossy surface with a protection layer of noble metal is set. Said two punching surfaces and the glossy surface are situated at a location such that when installing, the pin will scrape with the two punching surfaces, and simultaneously contact said two punching surfaces and the glossy surface eventually.

In comparison with the electrical connector according to the prior art, the electrical connector according to the prevent invention has the following benefits: During the process of initial power-on, because the coarse surface is very sharp, dust and grime on the surfaces of the pin and the terminal can be scraped by the coarse surface with ease, reducing effectively the contact impedance and guaranteeing effective conduction for powering on smoothly. Under continuous operating conditions, the dust and grime on the glossy surface and the pin will be thinned and removed gradually by slight vibrations produced by computer hosts or operating fans without destroying the protection layer with noble metal. Thereby, the contact impedance is reduced and continuous conduction between the terminal and the pin is guaranteed.

DETAILED DESCRIPTION

Figure 1:
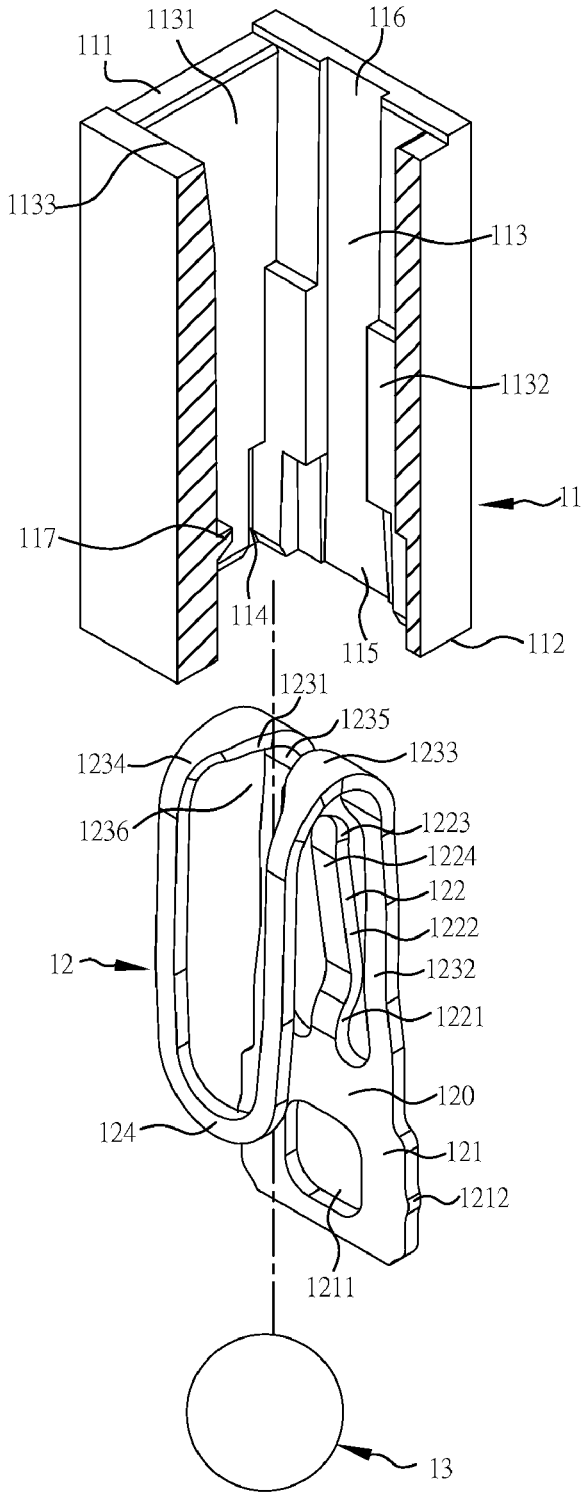
FIG. 1 shows a partial three-dimensional explosion view according to the first preferred embodiment of the present invention.
Figure 2:
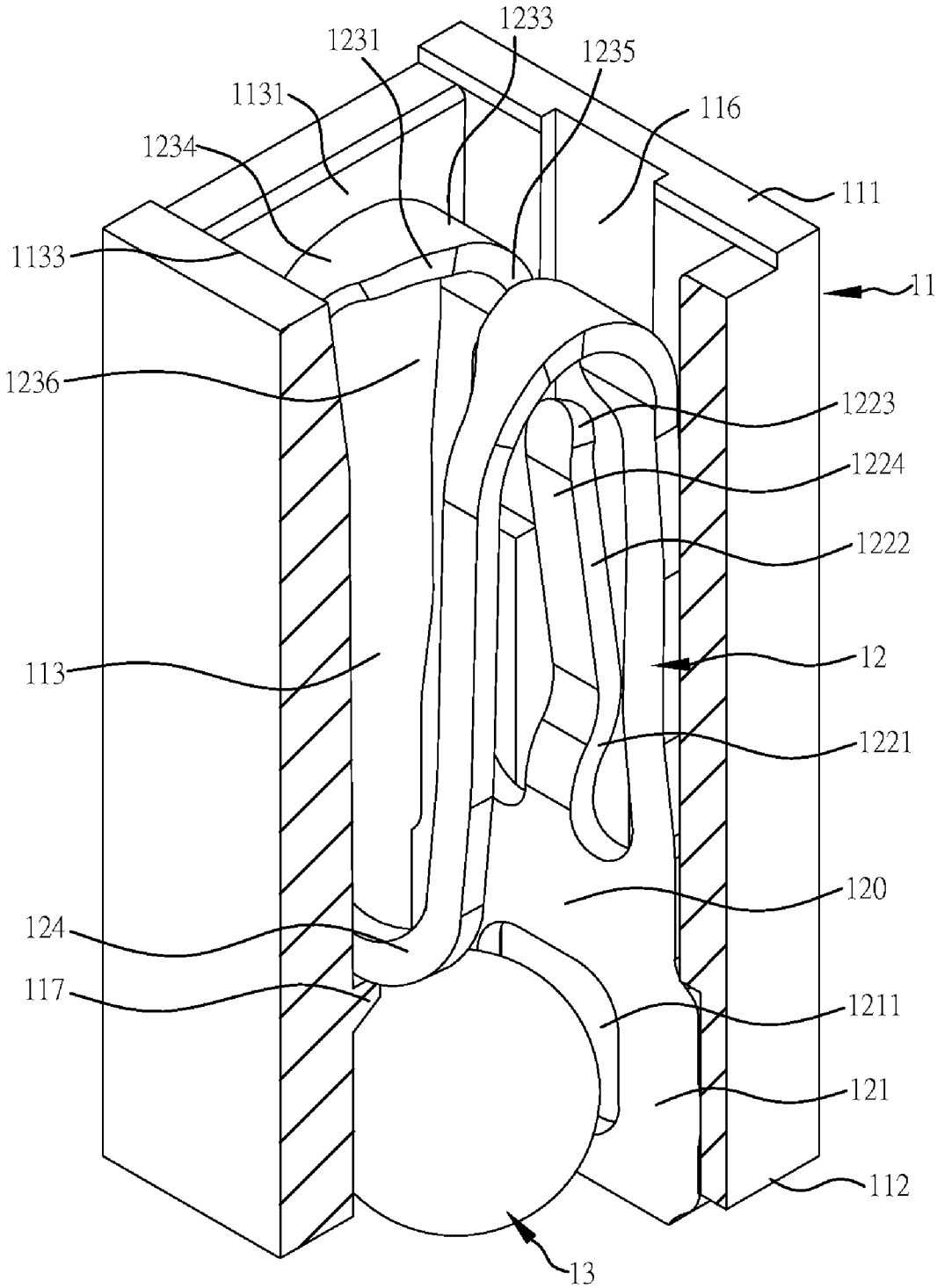
FIG. 2 shows a partial three-dimensional assembly view according to the first preferred embodiment of the present invention.

In order to make the structure and characteristics of the present invention to be further understood and recognized as well as its effectiveness, the detailed description of the present invention is provided as follows along with preferred embodiments and accompanying figures.

FIGS. 1 to 4 show an electrical connector according to a first preferred embodiment of the present invention. The electrical connector 1 is used for plugging the multiple pins 21 of a mating device 2. The electrical connector 1 comprises a body 11, one or more terminals 12 secured in the body 11, and one or more tin balls 13 also located in the body 11.

Referring to FIG. 1, the body 11 has a plurality of receiving cavities 113 passing through the top surface 111 and the bottom surface 112 thereof for receiving the terminals 12 and the tin balls 13. In addition, inside the receiving cavities 113 of the body 11, two first sidewalls 1131 are set opposite to each other, and a second sidewall 1132 and a third sidewall 1133 are set communicating with the two first sidewalls 1131.

The first sidewall 1131 has a fixing part near the bottom surface 112 for fixing the terminal 12. According to the present preferred embodiment, the fixing part is a recess 114 formed by recessing the first sidewall 1131 of the body 11. The recess 114 is located at the junction between the first sidewall 1131 and the second sidewall 1132.

At the center of the second sidewall 1132, a trench 116 is set passing through the top surface 111, which facilitates installation of the terminal 12 into the receiving cavity 113. Near the bottom surface 112, the second sidewall 1132 of the body 11 is recessed to form a space 115. The space 115 provides space for deformation of the terminal 12. Thereby, the tin ball 13 can be installed easily.

Near the bottom surface 112, the third sidewall 1133 protrudes into the receiving cavity 113 to form a stopping block 117.

Referring to FIGS. 1 to 4, the terminal 12 is formed from metal materials by punching and is approximately inverted U-shaped. The terminal 12 comprises a main part 120, a soldering part 121 extending downwards from the lower end of the main part 120, an elastic piece 122 and two contact arms 123 extending upwards from the main part 120 for connecting with the pin 21, and a stopping part 124 formed by extending connectedly downwards from the two contact arms 123 and mating with the stopping block 117.

Said two contact arms 123 are formed by extending from two sides of the top of the main part 120. Each of the contact arms 123 comprises a connection part 1232 extending straight upwards from the main part 120, a clipping part 1233 bent and extending from the connection part 1232, and a guiding part 1234 extending from the end of the clipping part 1233. Two opposite clipping parts 1233 form a clipping space 1235 for containing the pin 21. The width of the clipping space 1235 is smaller than the diameter of the pin 21, so that the terminal 12 exerts a clipping force to the pin 21. Two opposite guiding parts 1234 form a guiding space 1236. The width of the guiding space 1236 is greater than the diameter of the pin 21 for guiding the pin to enter the clipping space 1235.

Because the two contact arms 123 are formed by punching away the metal materials at the center, a punching surface 1231 inside each of the contact arms 123 forms a coarse surface. The punching surface 1231 has tiny burrs, which are relatively rugged with a larger coefficient of friction.

According to another embodiment, the terminal 12 can have only one contact arm 123 or have two or more contact arms 123. Correspondingly, the terminal 123 has one punching surface 1231 or has two or more punching surface 1231.

The elastic piece 122 is formed by extending and bending from the top end of the center of the main part 120, and comprises a first tilt part 1221 bending away from the pin 21, a second tilt part 1222 extending from the end of the first tilt part 1221 and bending towards the pin 21, and a third tilt part 1223 extending from the end of the second tilt part 1222 and bending away from the pin 21. The junction between the second tilt part 1222 and the third tilt part 1223 is a glossy surface 1224, used for contacting with the pin 21. The elastic piece 122 is bent multiple times, thereby has better elasticity for contacting closely with the pin 21.

According to another embodiment, the terminal 12 can have two or more elastic pieces 122. Correspondingly, the terminal 12 can have two or more glossy surfaces 1224.

The soldering part 121 is used for soldering with a circuit board (not shown in the figures). Besides, at the center of the soldering part 121, a hole 1211 is set for movably accommodating the tin ball 13. When the electrical connector is soldered on the circuit board, the hole 1211 is beneficial for adjusting the position of the tin ball 13 automatically and aligning with the circuit board levelly. Thereby, the electrical connector 1 and the circuit board can have excellent electrical conduction. In addition, a positioning part 1212 is formed on both sides of the soldering part 121, respectively.

Figure 3:
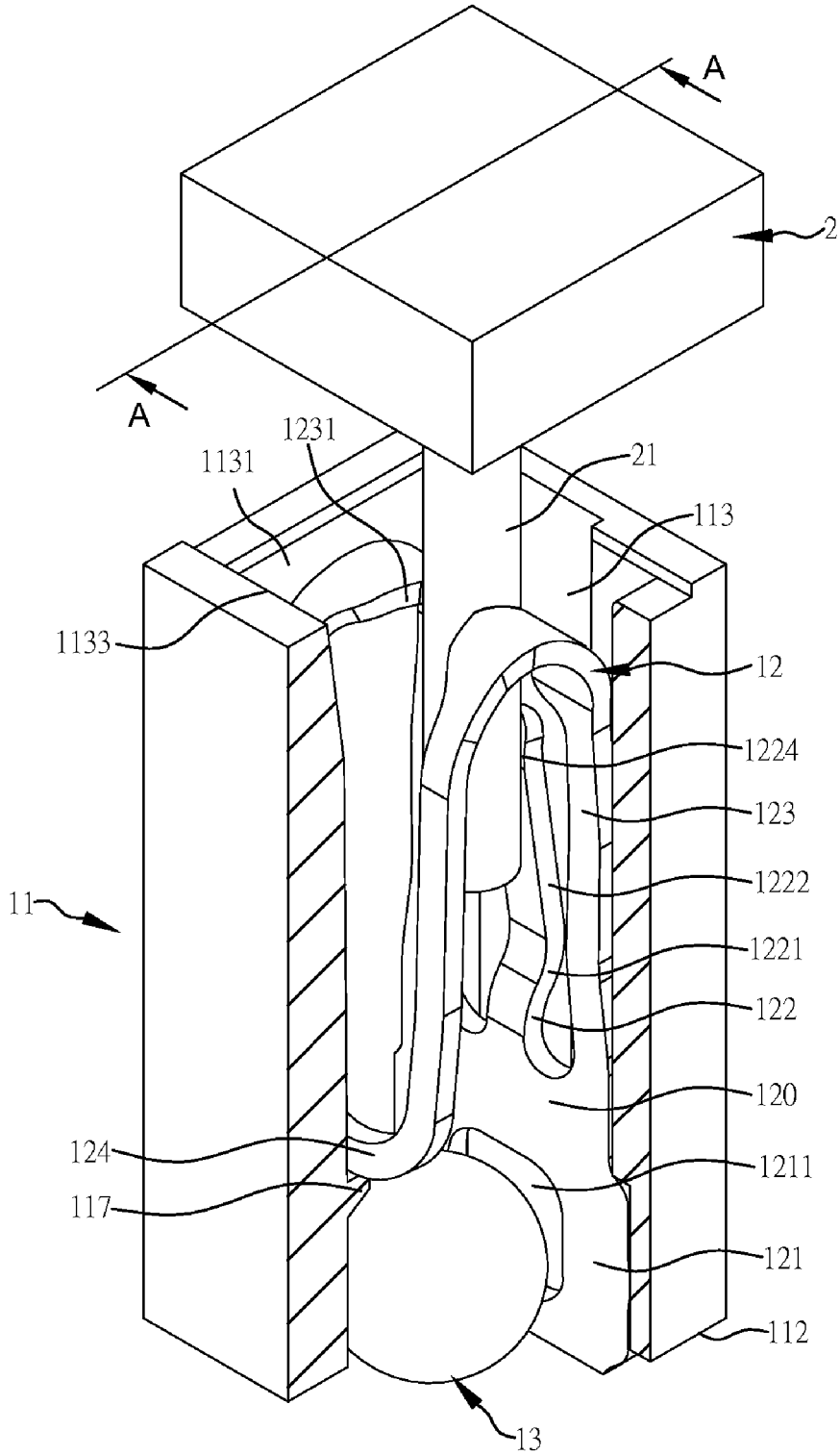
FIG. 3 shows a partial cross-sectional view when a jointing device is plugged according to the first preferred embodiment of the present invention.
Figure 4:
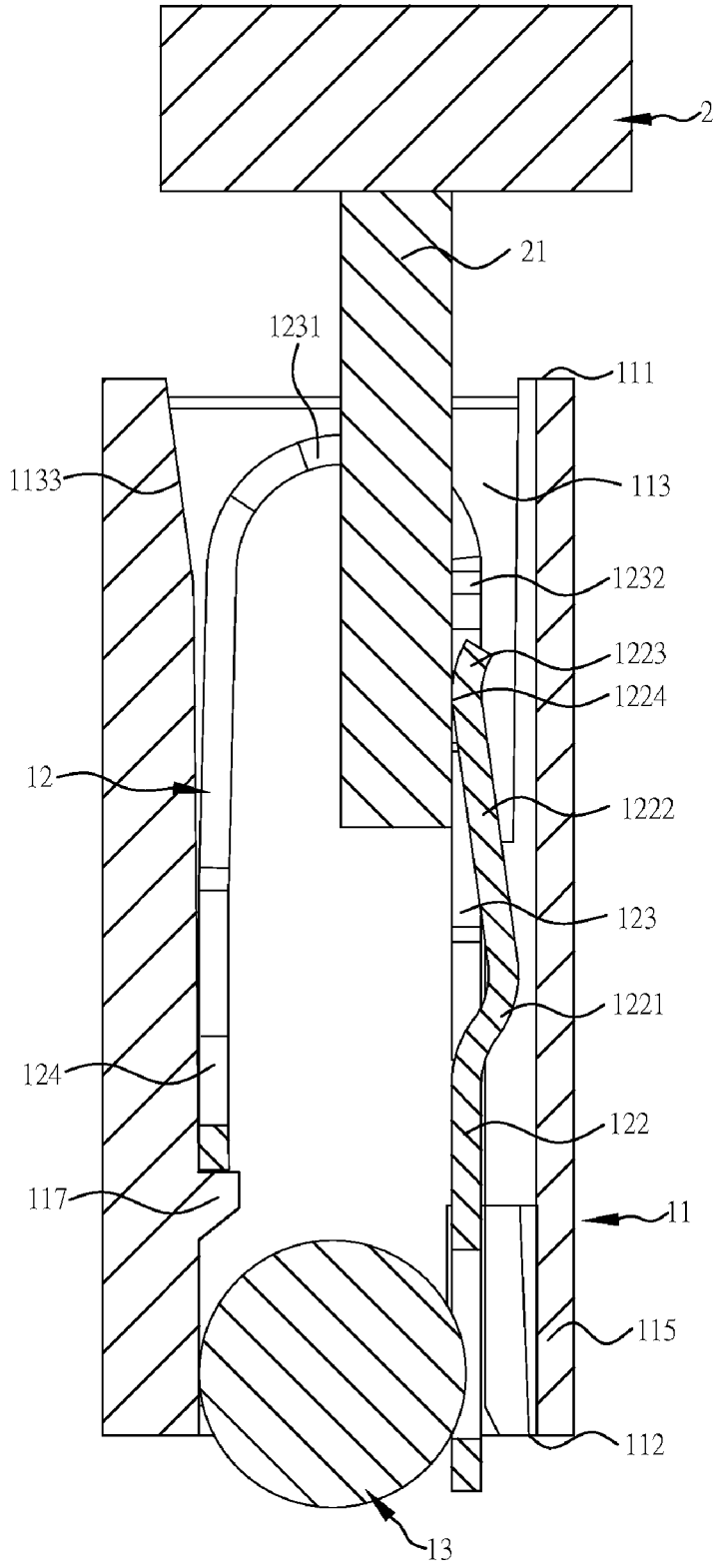
FIG. 4 shows a cross-sectional view along the A-A direction in FIG. 3.

Referring to FIG. 3 and FIG. 4, during assembling, the terminal 12 is inserted from bottom up to the receiving cavity 113 first. The elastic piece 122 is partially positioned in the trench 116. The positioning part 1212 inserted to the recess 114 for securing the terminal 12 in the body 11. The stopping part 124 is positioned above the stopping block 117. When the terminal 12 moves down, the stopping block 117 will block the stopping part 124 for preventing the terminal 12 from moving down excessively. In addition, the soldering part 121 and the space 115 are set correspondingly for implanting the tin ball 13.

Afterwards, the tin ball 13 is implanted to the receiving cavity 113. The soldering part 121 experiences forces exerted by the tin ball 13, and thus deforms towards the space 115. By doing so, the pressure exerted by the tin ball 13 to the terminal 12 can be relieved. After a part of the tin ball 13 is guided into the hole 1211, the soldering part 121 can recover to its original position. Thereby, the tin ball 13 is secured in the receiving cavity 113 for implementing the assembly process of the electrical connector 1.

When using, the mating device 2 inserts into the electrical connector 1. The pin 21 first enters the guiding space 1236. Then, a driving means of the electrical connector 1 moves the mating device 2 and hence drives the pin 21 to slide towards the clipping space 1235. At the same time, the pin 21 and the punching surfaces 1231 scrape to each other. Finally, the pin 21 is forced to move between the two punching surfaces 1231, and the bottom end thereof contacts with the glossy surface 1224. Thereby, the two punching surfaces 1231 and the glossy surface 1224 connect electrically to the pin 21 simultaneously.

The pin 21 and the punching surfaces 1231 scrape to each other. Because the punching surfaces 1231 have sharp surfaces with a large coefficient of friction, the dust and grime on the surfaces of the pin 21 and the terminal 12 can be scraped and removed with ease, thus reducing the impedance therebetween and beneficial to electrical conduction. Accordingly, when the installation of the computer host is finished, excellent conduction can be realized during powering on.

Said two punching surfaces 1231 and the glossy surface 1224 can connect electrically to the pin 21 simultaneously with multiple contacts point, hence increasing the contact area and reducing the impedance effectively, which is beneficial for electrical conduction. Besides, multiple conduction paths can be formed between the pin 21 and the terminal 12.

The extending direction of the elastic piece 122 is opposite to the inserting direction of the pin 21. and the elastic piece 122 contacts directly with the bottom end of the pin 21. Thereby, the signal transmission path is short between the pin 21 and the elastic piece 122, and the impedance is lowered and the electrical conduction is excellent.

When the punching surfaces 1231 contact the pin 21 initially, if over-scraping occurs therebetween, the protection layers of noble metal on their surfaces will be scraped and hence exposing the metal material (such as copper) used for electrical conduction to the air. Under continuous operation of the computer host, the metal material will combine with oxygen eventually to produce oxides, which will block conduction between the punching surfaces 1231 and the pin 21. At this moment, another conduction path is formed between the glossy surface 1224 and the pin 21 to guarantee continuous electrical conduction. This is because the glossy surface 1224 has a smaller coefficient of friction. When the pin 21 contacts with the glossy surface 1224 initially, the dust and grime on the surfaces of the pin 21 and the glossy surface 1224 are hard to be removed temporarily. Under continuous operation of the computer host, the dust and grime will be thinned and removed gradually by slight vibrations produced by computer hosts or operating fans without destroying the protection layer with noble metal. Thereby, the contact impedance is reduced effectively. Under continuous operations, when the oxides block continuous conduction between the punching sections 1231 and the pin 21, the signal transmission path formed between the glossy surface 1224 and the pin 21 can guarantee continuous conduction between the terminal 12 and the pin 21.

Figure 5:
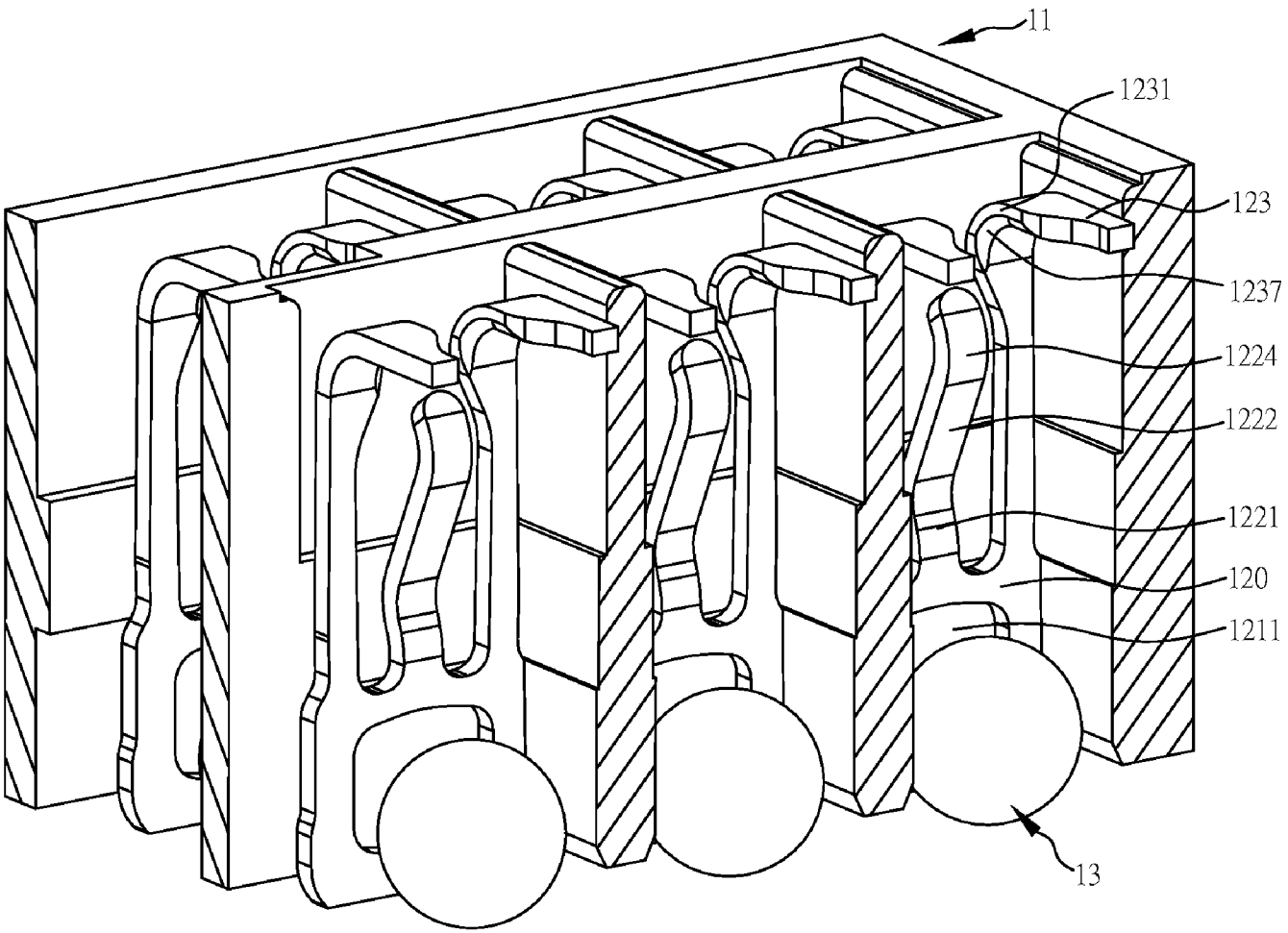
FIG. 5 shows a partial three-dimensional assembly view according to the second preferred embodiment of the present invention.
Figure 6:
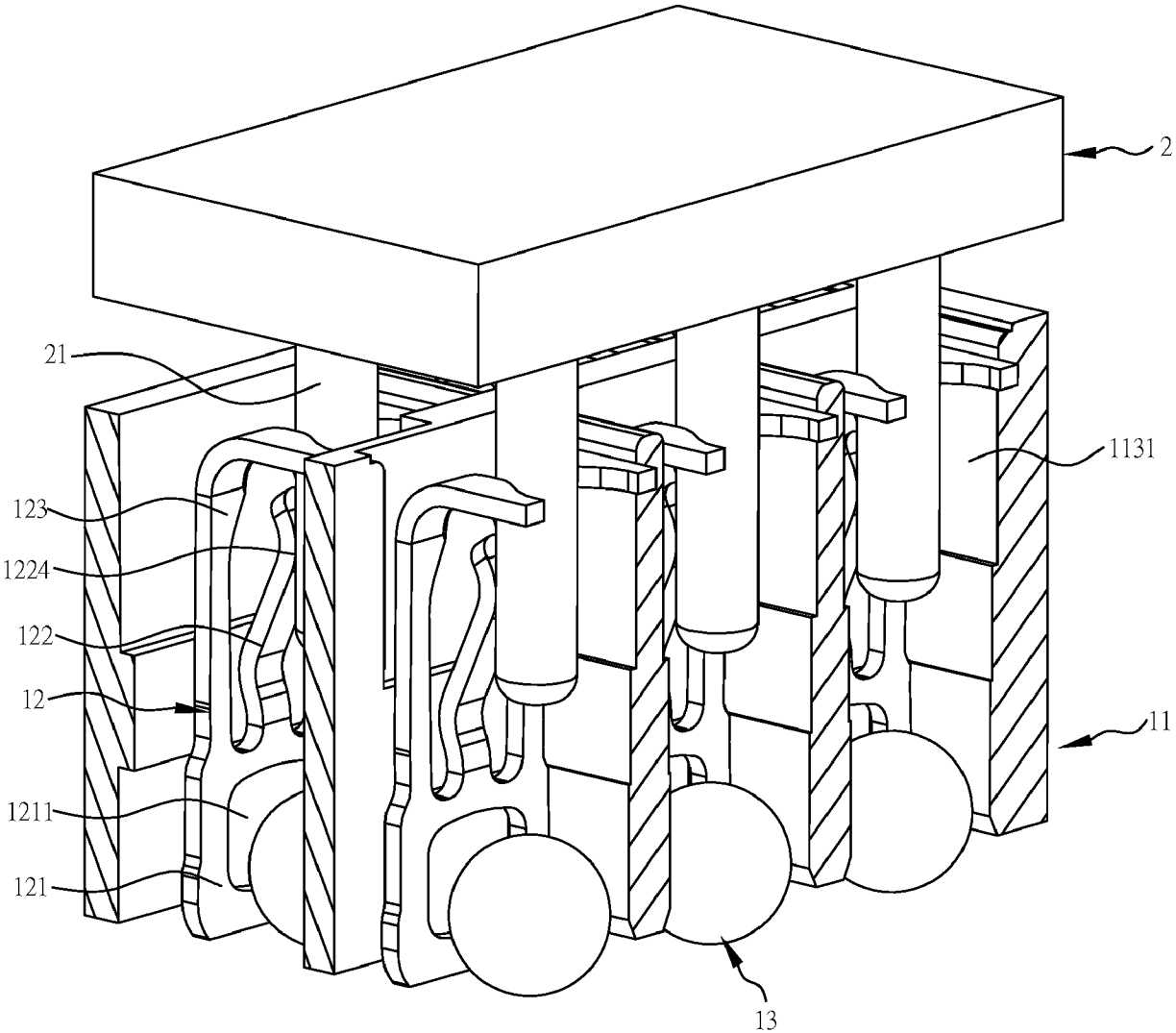
FIG. 6 shows a partial cross-sectional view when a jointing device is plugged according to the second preferred embodiment of the present invention.

FIG. 5 and FIG. 6 show an electrical connector according to a second preferred embodiment of the present invention. The differences between the first and second preferred embodiments are:

1. A rounded corner 1237 is set at the bottom edge of the punching surface 1231. (Of course, the rounded corners 1237 can be set at other edges.) When the pin 21 inserts to the punching surfaces 1231 initially, the part above the bottom edge of the punching surface 1231 is used for scraping the dust and grime. The contact between the rounded corner 1237 and the pin 21 is smooth for preventing the punching surfaces 1231 from scraping the pin 21 excessively.
2. The terminal 12 does not have the stopping part 124 and the body does not have the stopping block 117.
3. The first sidewall 1131 is ladder-shaped for providing space for deformation of the contact arms 123 and is beneficial for insertion of the pin 21.

To sum up, the electrical connector according to the present invention has the following advantages:

1. By setting both of the coarse surface for scraping the dust and grime and glossy surface on the terminal, the initial power-on of a computer can be guaranteed. Under continuous operating conditions of the computer host, the dust and grime will be thinned and removed gradually by slight vibrations produced by computer hosts or operating fans without scraping the protection layer with noble metal. Thereby, the contact impedance is reduced and effective electrical conduction is guaranteed under continuous operations.
2. The extending direction of the elastic piece is opposite to the inserting direction of the pin. The signal is transmitted directly from the pin to the third tilt part, and then from the elastic piece down. The signal transmission path is short and hence the impedance is low, beneficial to effective electrical conduction.
3. Because the third tilt part is bent away from the pin, when the pin contacts the elastic piece, scraping by the ends of the punching surfaces formed by punching on the pin can be avoided.
4. The contact between the rounded corner and the pin is smooth, avoiding over-scraping on the pin by the punching sections.

Accordingly, the present invention conforms to the legal requirements owing to its novelty, non-obviousness, and utility. However, the foregoing description is only a preferred embodiment of the present invention, not used to limit the scope and range of the present invention. Those equivalent changes or modifications made according to the shape, structure, feature, or spirit described in the claims of the present invention are included in the appended claims of the present invention.

The invention claimed is:

1. An electrical connector, used for connecting a mating device with multiple pins, characterized by comprising:
   a body; and
   at least one terminal secured in the body, and having at least one coarse surface and at least one glossy surface with a protection layer of noble metal, and the coarse surfaces and the glossy surfaces located at a position for making the pins scrape with the coarse surfaces and finally contact the coarse surfaces and the glossy surfaces simultaneously.

2. The electrical connector of claim 1, characterized in that the terminal has punching surfaces formed by punching; and the punching surfaces form the coarse surfaces.

3. The electrical connector of claim 2, characterized in that the terminal has two contact arms formed by punching away the center part of a metal material; and
   the punching surfaces are located at the inner sides of the contact arms.

4. The electrical connector of claim 1, characterized in that the terminal has an elastic piece, and the surface thereof forming the glossy surface.

5. The electrical connector of claim 4, characterized in that the elastic piece comprises a first tilt part bent away from the pin, a second tilt part extending from the end of the first tilt part and bent towards the pin, and a third tilt part extending from the end of the second tilt part and bent away from the pin, and the glossy surface being set at the junction between the second tilt part and the third tilt part.

6. The electrical connector of claim 4, characterized in that the extending direction of the elastic piece is opposite to the inserting direction of the pin.

7. The electrical connector of claim 1, characterized in that the coarse surface has a rounded corner on at least one edge.

8. An electrical connector, used for connecting a mating device with multiple pins, characterized by comprising:
   a body; and
   at least one terminal, secured in the body, formed by punching a metal sheet, having two contact arms formed by punching away the center part of the metal sheet, having two punching surfaces at the inner insides of the two contact arms, having an elastic piece, having a glossy surface with a protection layer of noble metal inside the elastic piece, and the two punching surfaces and the glossy surface locating at a position for making the pins scrape with the two punching surfaces and finally contact the two punching surfaces and the glossy surface simultaneously.

9. The electrical connector of claim 8, characterized in that the terminal further has a main part; and the two contact arms and the elastic piece are extended from the same end of the main part.

10. The electrical connector of claim 9, characterized in that the two contact arms extend from two sides of an end of the main part, respectively; and the elastic piece is bent and extends from the center part of the same end of the main part.

11. The electrical connector of claim 8, characterized in that a rounded corner is set on at least one edge of the punching surfaces.

12. The electrical connector of claim 8, characterized in that the ends of the two contact arms extends and connects together to form a stopping part; and the a stopping block is formed on the body below the stopping part.

13. The electrical connector of claim 8, characterized in that the elastic piece comprises a first tilt part bent away from the pin, a second tilt part extending from the end of the first tilt part and bent towards the pin, and a third tilt part extending from the end of the second tilt part and bent away from the pin, and the glossy surface being set at the junction between the second tilt part and the third tilt part.

* * * * *